US010953277B2

(12) United States Patent
Fay

(10) Patent No.: US 10,953,277 B2
(45) Date of Patent: Mar. 23, 2021

(54) SHOULDER MOTION EXERCISE DEVICE AND METHOD OF USE

(71) Applicant: MISIG INC., Des Plaines, IL (US)

(72) Inventor: Bernard Fay, Des Plaines, IL (US)

(73) Assignee: MISIG, INC., Des Plaines, IL (US)

( * ) Notice: Subject to any disclaimer, the term of this patent is extended or adjusted under 35 U.S.C. 154(b) by 27 days.

(21) Appl. No.: 16/555,332

(22) Filed: Aug. 29, 2019

(65) Prior Publication Data

US 2019/0381352 A1 Dec. 19, 2019

Related U.S. Application Data

(63) Continuation of application No. 16/048,419, filed on Jul. 30, 2018, now Pat. No. 10,398,935, which is a continuation of application No. 15/471,427, filed on Mar. 28, 2017, now Pat. No. 10,226,666, which is a (Continued)

(51) Int. Cl.

| | |
|---|---|
| ***A63B 23/12*** | (2006.01) |
| ***A63B 69/36*** | (2006.01) |
| ***A63B 21/02*** | (2006.01) |
| ***A63B 69/00*** | (2006.01) |
| ***A63B 15/00*** | (2006.01) |
| ***A63B 60/22*** | (2015.01) |
| ***A63B 60/32*** | (2015.01) |
| ***A63B 60/20*** | (2015.01) |
| ***A63B 21/00*** | (2006.01) |
| ***A63B 21/04*** | (2006.01) |
| ***A63B 21/055*** | (2006.01) |

(52) U.S. Cl.

CPC ..... *A63B 23/1272* (2013.01); *A63B 15/00* (2013.01); *A63B 21/021* (2015.10); *A63B 21/04* (2013.01); *A63B 21/0557* (2013.01); *A63B 21/4017* (2015.10); *A63B 60/20* (2015.10); *A63B 60/22* (2015.10); *A63B 60/32* (2015.10); *A63B 69/0059* (2013.01); *A63B 69/3608* (2013.01); *A63B 69/3623* (2013.01); *A63B 69/3632* (2013.01); *A63B 21/4019* (2015.10); *A63B 2209/10* (2013.01); *A63B 2225/09* (2013.01)

(58) Field of Classification Search

CPC ..... A63B 21/02–0557; A63B 21/4017; A63B 23/1272; A63B 15/00; A63B 60/20; A63B 60/22; A63B 60/32; A63B 69/0002; A63B 69/0059; A63B 69/36; A63B 69/3608; A63B 69/38–385; A63B 2069/0008

See application file for complete search history.

(56) References Cited

U.S. PATENT DOCUMENTS

| | | | |
|---|---|---|---|
| 1,137,349 | A | 4/1915 | Patterson |
| 1,953,916 | A | 4/1934 | Adams |
| 2,022,910 | A | 12/1935 | Hanley |

(Continued)

OTHER PUBLICATIONS

International Search Report and Written Opinion of the International Searching Authority for International Application No. PCT/US16/59821, dated Dec. 1, 2016, twelve pages.

*Primary Examiner* — Jennifer Robertson

(74) *Attorney, Agent, or Firm* — Dawsey Co., LPA; David J. Dawsey

(57) ABSTRACT

A shoulder motion exercise device, kit, and method of use having a retainer, a plurality of connectors, an extender, and a slider. The device aids in the stretching and exercise of at least a shoulder and a portion of the torso.

20 Claims, 8 Drawing Sheets

Related U.S. Application Data continuation of application No. 14/938,291, filed on Nov. 11, 2015, now Pat. No. 9,630,057.

(56) References Cited

U.S. PATENT DOCUMENTS

| | | | | |
|---|---|---|---|---|
| 3,095,198 | A | 6/1963 | Gasche | |
| 3,339,926 | A | 9/1967 | Coupar | |
| 3,858,881 | A | 1/1975 | Hurwitz | |
| 3,861,688 | A | 1/1975 | Butler | |
| 3,940,134 | A | 2/1976 | Bieganowski | |
| 4,134,589 | A | 1/1979 | Arena | |
| 4,328,964 | A * | 5/1982 | Walls | A63B 21/4035 473/229 |
| 5,340,110 | A | 8/1994 | Mollis | |
| 5,529,306 | A | 6/1996 | Staats et al. | |
| 5,542,674 | A | 8/1996 | Kim | |
| 5,865,685 | A * | 2/1999 | Thomas | A63B 69/3608 473/213 |
| 6,027,413 | A | 2/2000 | Smith et al. | |
| 6,458,036 | B1 * | 10/2002 | Gutierrez | A63B 69/0059 473/207 |
| 6,599,200 | B1 * | 7/2003 | Kallassy | A63B 69/3632 473/204 |
| 6,827,654 | B2 | 12/2004 | Meyer | |
| 6,863,616 | B2 | 3/2005 | Snyder et al. | |
| 6,991,554 | B2 | 1/2006 | Ryan | |
| 6,994,633 | B2 | 2/2006 | Czaja et al. | |
| 7,081,053 | B2 | 7/2006 | Kallassy | |
| 7,083,528 | B2 * | 8/2006 | Marland | A63B 69/0059 473/212 |
| 7,128,658 | B2 | 10/2006 | DuFour | |
| 7,134,968 | B1 | 11/2006 | Pryor | |
| 7,156,748 | B2 * | 1/2007 | Burke | A63B 69/0059 473/276 |
| 7,381,140 | B1 | 6/2008 | Stanisic | |
| 7,445,570 | B2 | 11/2008 | Rodgers et al. | |
| 7,556,568 | B2 | 7/2009 | Ryan | |
| 7,559,859 | B2 | 7/2009 | Rodgers, Jr. et al. | |
| 7,648,422 | B2 | 1/2010 | Brooks et al. | |
| 7,758,436 | B2 | 7/2010 | Reynolds | |
| 7,766,757 | B2 | 8/2010 | Brooks et al. | |
| 7,811,185 | B1 | 10/2010 | Reynolds | |
| 8,187,124 | B2 | 5/2012 | Ciesar et al. | |
| 8,500,569 | B2 | 8/2013 | Moore | |
| 8,632,414 | B1 | 1/2014 | Rippberger | |
| 8,777,783 | B1 | 7/2014 | Rodgers, Jr. et al. | |
| 9,089,756 | B1 | 7/2015 | Kirshberg | |
| 9,630,057 | B1 | 4/2017 | Fay | |
| 2003/0178773 | A1 * | 9/2003 | Meyer | A63B 69/0059 273/276 |
| 2004/0048696 | A1 | 3/2004 | Ciesar | |
| 2005/0054460 | A1 | 3/2005 | Keating | |
| 2007/0191129 | A1 | 8/2007 | Kearns et al. | |
| 2009/0258719 | A1 | 10/2009 | Wortman | |
| 2012/0034988 | A1 | 2/2012 | Fontanilla | |

* cited by examiner

Vertical Elevation

Horizontal Adduction
PRIOR ART

SHOULDER MOTION EXERCISE DEVICE AND METHOD OF USE

CROSS-REFERENCE TO RELATED APPLICATIONS

This application is a continuation of U.S. patent application Ser. No. 16/048,419, filed on Jul. 30, 2018, which is a continuation of U.S. patent application Ser. No. 15/471,427, now U.S. Pat. No. 10,226,666, filed on Mar. 28, 2017, which is a continuation of U.S. patent application Ser. No. 14/938,291, now U.S. Pat. No. 9,630,057, filed on Nov. 11, 2015, the content of which is hereby incorporated by reference as if completely written herein.

STATEMENT REGARDING FEDERALLY SPONSORED RESEARCH OR DEVELOPMENT

Not applicable.

TECHNICAL FIELD

The present disclosure relates generally to a shoulder motion exercise device, in particular, for exercising both shoulders of a human user in adduction and abduction, and in some embodiments, for use in exercises simulating a golf swing.

BACKGROUND OF THE INVENTION

The present invention relates to a shoulder exercise device and method of use. The human shoulder is one of the most anatomically complex joints of the human body, and is capable of some of the most complex patterns of human motion. In many sports, such as baseball, tennis and golf, just to name a few, the shoulder is subject to severe stresses and is susceptible to many types of injury. It is well-established that a regular program of shoulder stretching and strengthening exercises may decrease the incidence of injury. Unfortunately, even though golf, for example, is considered a low-intensity activity, it is not an injury-free activity. More unfortunately, the golf swing is a unique type of motion that is not easily replicated in a training modality. Most golf-related injuries are associated with overuse or poor swing mechanics, and it has been reported that between 8% to 21% of total reported golf injuries occur at the shoulder. To develop effective training and rehabilitative techniques for any athlete, there must be a clear understanding of the mechanics involved in accomplishing the sport.

With more individuals golfing, particularly in the senior sector, injuries are bound to occur. The shoulder joint ranks among the top 5 most injured sites. Problems at the shoulder due to aging include loss of flexibility, rotator cuff degeneration, and acromioclavicular joint degenerative arthritis; all of which can be aggravated by the repetitive nature of the golf swing.

The literature abounds with the importance of sport-specific warm-up, training, and rehabilitation programs. More unfortunately, the golf swing is a unique type of motion that is not easily replicated in a training modality. A review of the literature reveals that shoulder range of motion (ROM) and flexibility is strongly correlated to the age of the subject. Studies discussing shoulder injuries in golf also frequently mention the effects of aging, including the relationship between degenerative changes and rotator cuff tears. Data has revealed that Senior PGA Tour professionals had less upper body rotation at peak backswing than younger PGA Tour professionals. This leads us to ask not only what the normal motions at the shoulder throughout the golf swing are, but also if those motions change with aging and its associated reductions in flexibility and ROM.

Thus, it can be inferred that increasing shoulder ROM and strength, while maintaining the mechanics of a sound golf swing, would be highly helpful to golfers of many skill levels. Perhaps because of the complexity of shoulder motions, various descriptors have been used to describe shoulder motions. For the purposes of this specification, the following terms are defined and used:

Vertical Elevation (VE)

As seen in FIG. 1, an absolute angle between the humerus and a vector connecting a point midway on a line between the shoulder joint centers (S) to a point midway on a line between the femoral joint centers (F) (trunk vector=T). Clinically, this is a combination of shoulder forward flexion and shoulder abduction. An angle of 0° is defined when the upper arm is parallel to the trunk vector and next to the body. In the golf context, the usual motion of gripping a golf club with both hands in preparation for a swing involves placing the hands in close proximity to one another with a slight degree of vertical elevation of the shoulders. Vertical elevation is pictorially seen in FIG. 1, with 0 degrees of vertical elevation representing the arm in a substantially fully dependent position, 90 degree of vertical elevation representing the arm substantially parallel to the shoulder, and 180 degree of vertical elevation representing the arm substantially fully raised above the head.

Horizontal Adduction (HA)

As seen in FIG. 2, motion of the humerus as represented by the motion of an axial line along the length of the humerus (H) in the plane perpendicular to the trunk vector (T) described above (transverse plane of the body). An angle of 0° is defined when the upper arm lies in the plane defined by the trunk vector and the vector connecting the shoulder joint centers (S). For convenience in labeling anterior and posterior motion, an angle of 90 degrees would represent the arm at substantially a right angle to the vector connecting the shoulder joint centers, denominated either +90 degrees for horizontal adduction to the front and −90 degrees for horizontal adduction to the rear. As a function of variable human flexibility, most individuals can horizontally adduct the arm in a forward direction to greater that +90 degrees and even cross the midline, while most individuals cannot horizontally adduct the arm rearward to the full −90 degree range. For the purpose of this specification, the term horizontal adduction is used to denote movement away from the midline, and the term horizontal abduction is used to denote movement towards or crossing the midline of the torso.

SUMMARY OF THE INVENTION

The disclosed invention relates to a shoulder motion exercise device and a method of use. The device may have a hand-grippable slider, an extender on which the slider can slide along an extender axial length and a connector joining the slider and a retainer, which is releasably securable to an elbow area or a peri-condylar area proximate to a humerus of a human user (U). The connector may be elastic and stretchable between a first functional position, where the slider and retainer are closest in space, and a second functional position where the slider and retainer are more distantly placed.

The extender is gripped in one hand and the slider in the other. As a hand holding the slider moves the slider along the extender, the arm gripping the slider tends to horizontally adduct and the arm gripping the extender to horizontally abduct. Combined with torso rotation, this has the effect of stretching and strengthening both the shoulders and torso. The retainer being fastened to the user at, or just above, the elbow on the arm gripping the extender, tends to keep the elbow on that same side from flexing. This has the salutary effect of helping to encourage good golf swing form, although one skilled in the art will appreciate that the shoulder motion exercise device and a method of use is not limited to golf related exercises and is particularly beneficial in shoulder rehabilitation. Illustrative examples of various embodiments of the invention, all provided by way of example and not limitation, are described.

BRIEF DESCRIPTION OF THE ILLUSTRATIONS

Without limiting the scope of the as disclosed herein and referring now to the drawings and figures.

Figure 1:
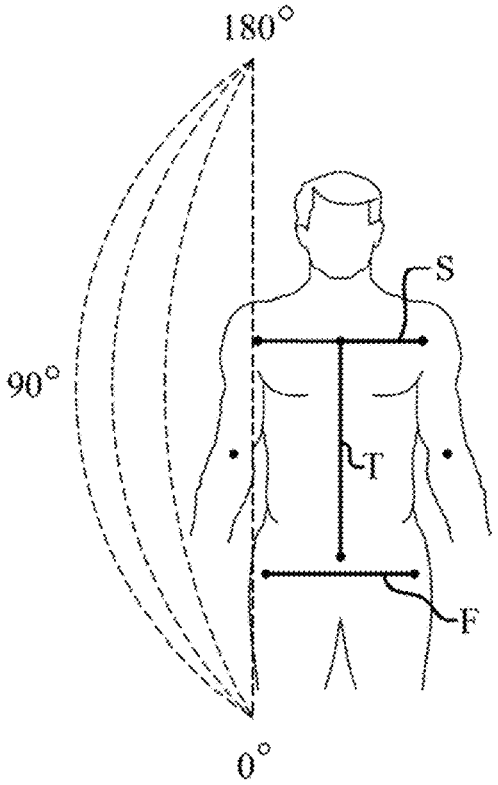
PRIOR ART Fig. 1
FIG. 1 is a prior art view of vertical elevation of the human shoulder.
Figure 2:
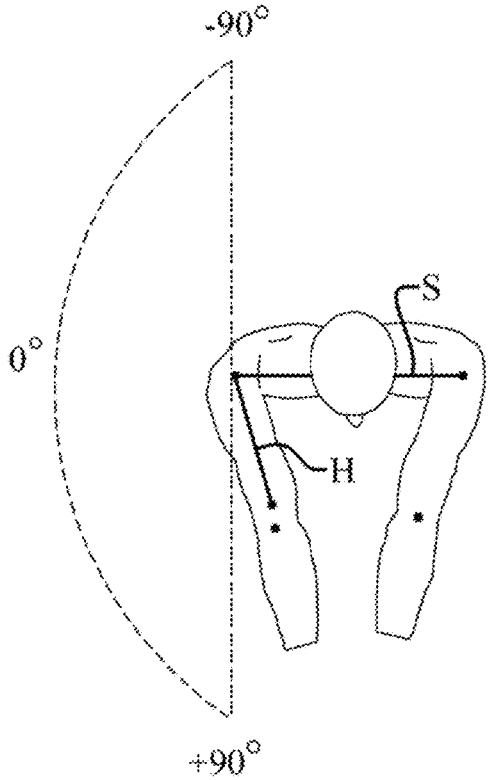
FIG. 2 is a prior art view of horizontal adduction of the human shoulder.

These illustrations are provided to assist in the understanding of the exemplary embodiments of the method of forming a shoulder motion exercise device and method of use described in more detail below and should not be construed as unduly limiting the specification. In particular, the relative spacing, positioning, sizing and dimensions of the various elements illustrated in the drawings may not be drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

What is claimed, as seen in FIGS. 1-13, is a shoulder motion exercise device (10) and method of use. As seen well in FIGS. 3 and 4, one embodiment includes a hand-grippable slider (400). The slider (400) may be slidably engaged with an extender (300) having an extender axial length (305), a proximal end (310), an extender gripping portion (330) having a grip portion length (332), a distal end (320), and an extender slidable portion (340). In turn, the slidable portion (340) may have a slidable portion length (342), a proximal slider position (360) and a distal slider position (370) along the slidable portion length (342).

Figure 3:
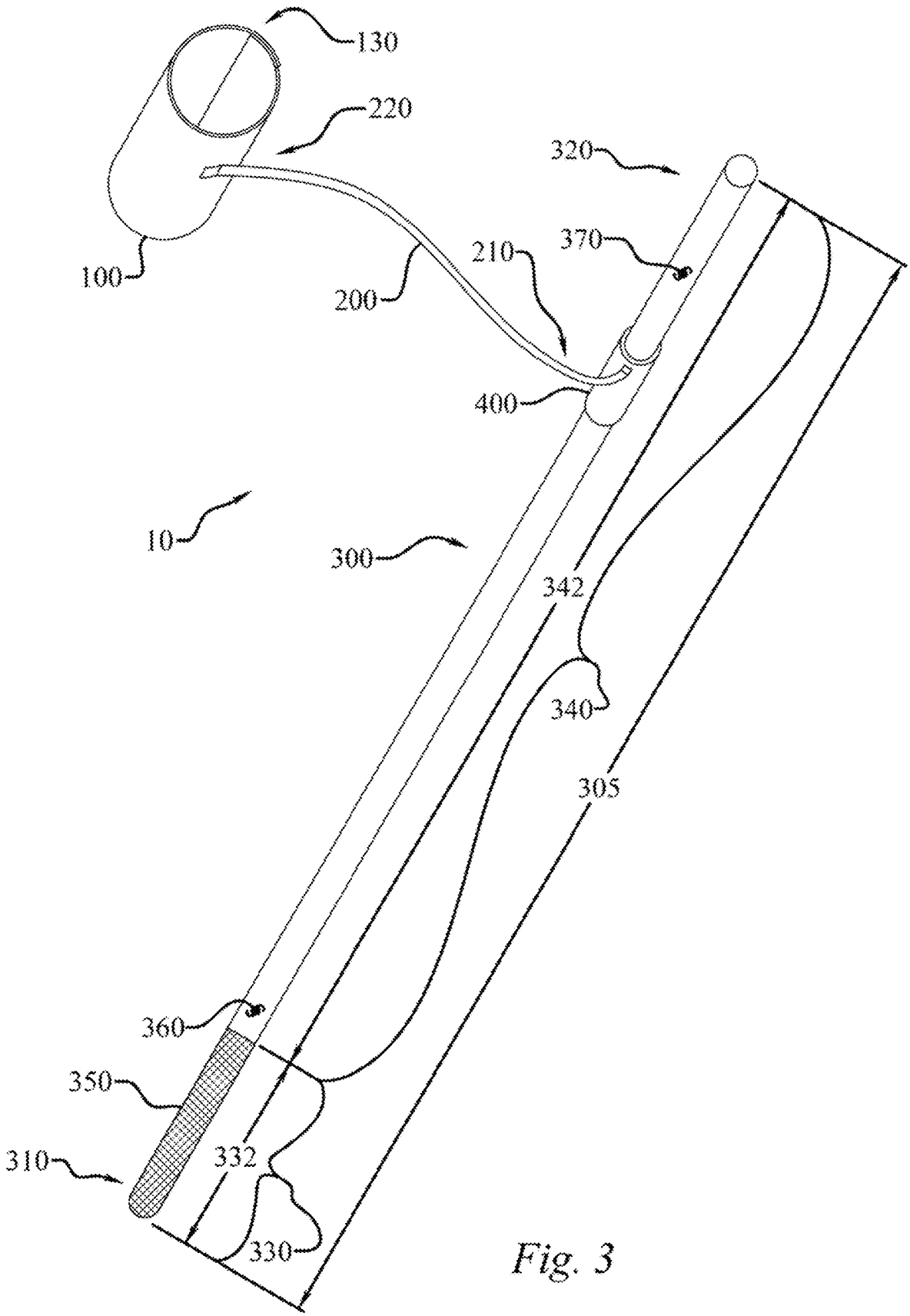
FIG. 3 is a perspective view of an embodiment of a shoulder exercise device.
Figure 4:
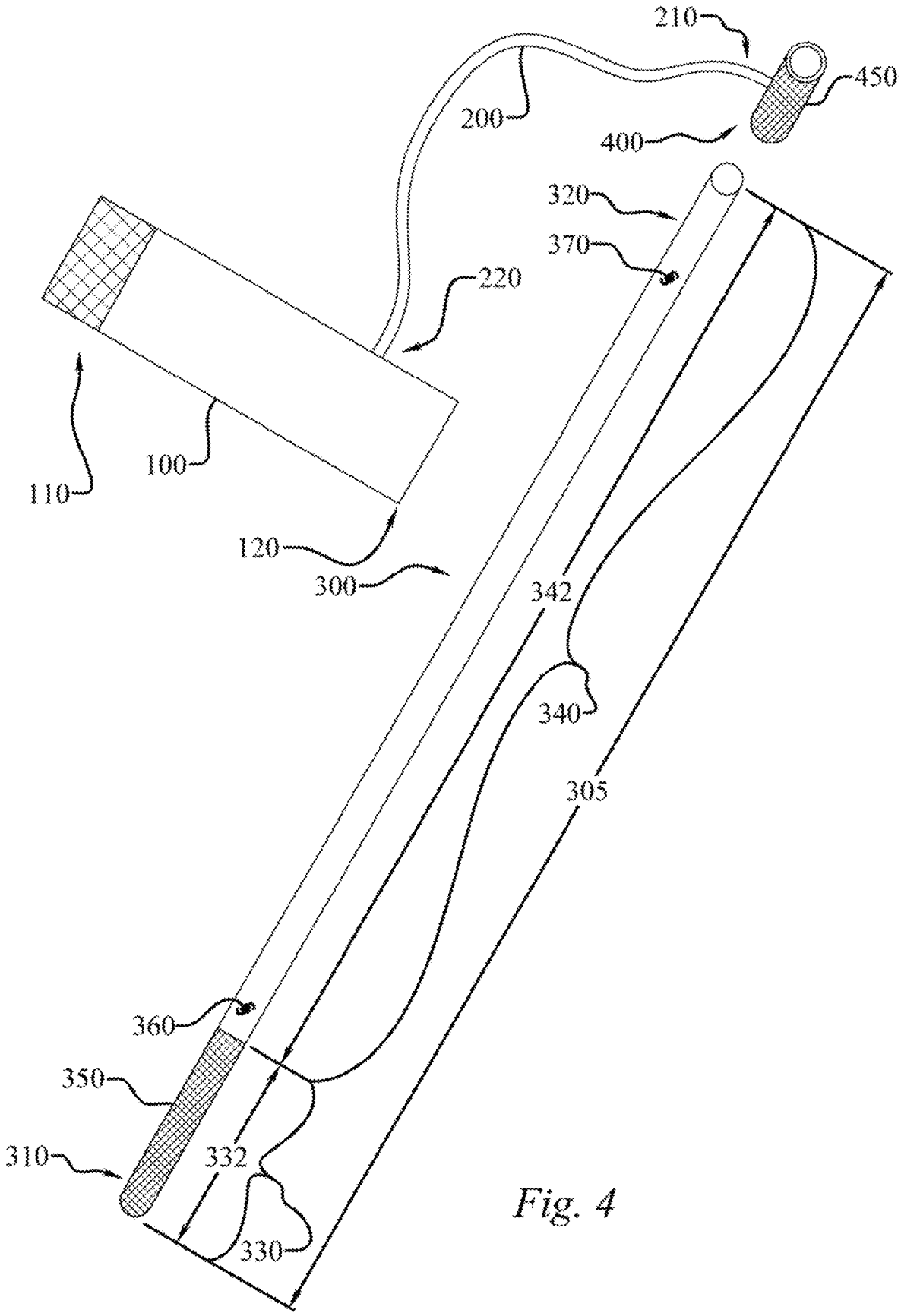
FIG. 4 is a perspective view of another embodiment of a shoulder exercise device.

With further reference to FIGS. 3 and 4, the hand-grippable slider (400) may be coupled to a proximal end (210) of a connector (200) which may be coupled at a distal end (220) of the connector (200) to a retainer (100). In some embodiments the connector (200) is an elastic resistance connector (200), as will be described later in more detail. In such embodiments the elastic resistance connector (200) has an unstretched connector length. The retainer (100) is designed to be secured to a user (U) at, or above, the elbow. As will be explained later in greater detail, in some embodiments the retainer (100) may be a strap or brace securely attached to an arm of a user (U) to carry out the intended exercises. A retainer (100) is shown attached at the elbow in FIGS. 10 and 11, and above the elbow in FIGS. 5 and 6. In some embodiments the retainer (100) is a peri-condylar humeral (PCH) connector (100) specifically designed so as to be releasably securable to a peri-condylar area proximate to a humerus of a human user (U).

Figure 5:
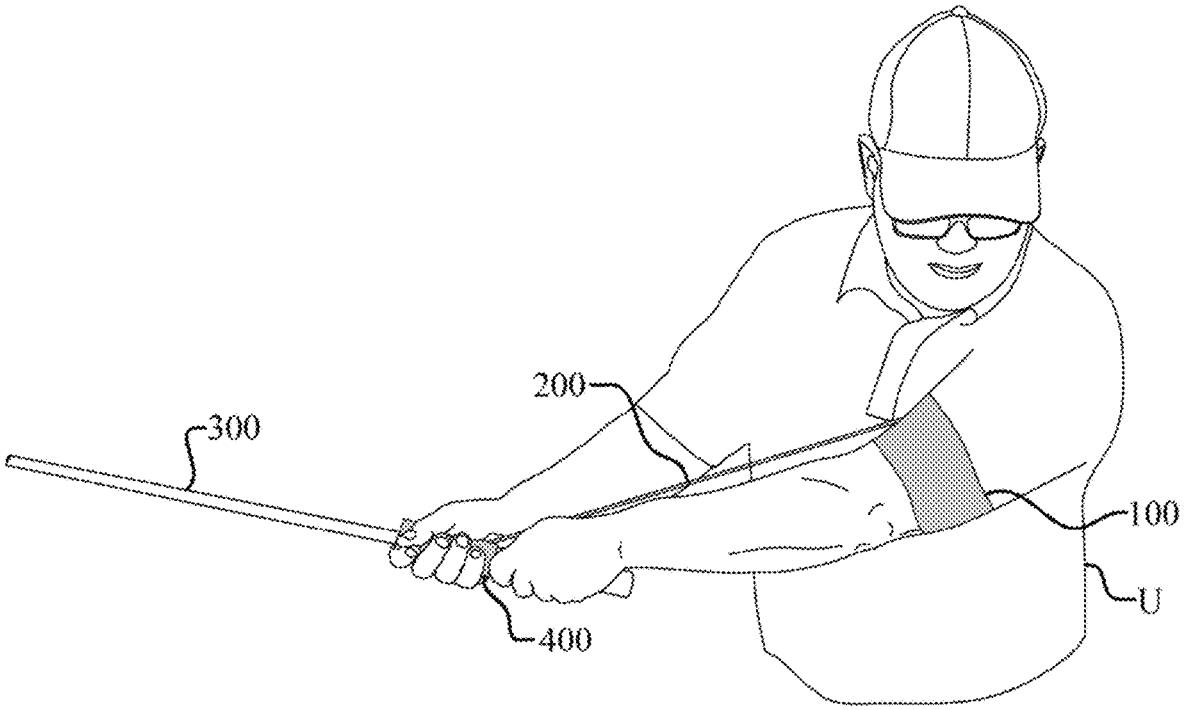
FIG. 5 is a frontal view of a human user employing an embodiment of the shoulder exercise device, with the user and device in a first functional position.
Figure 7:
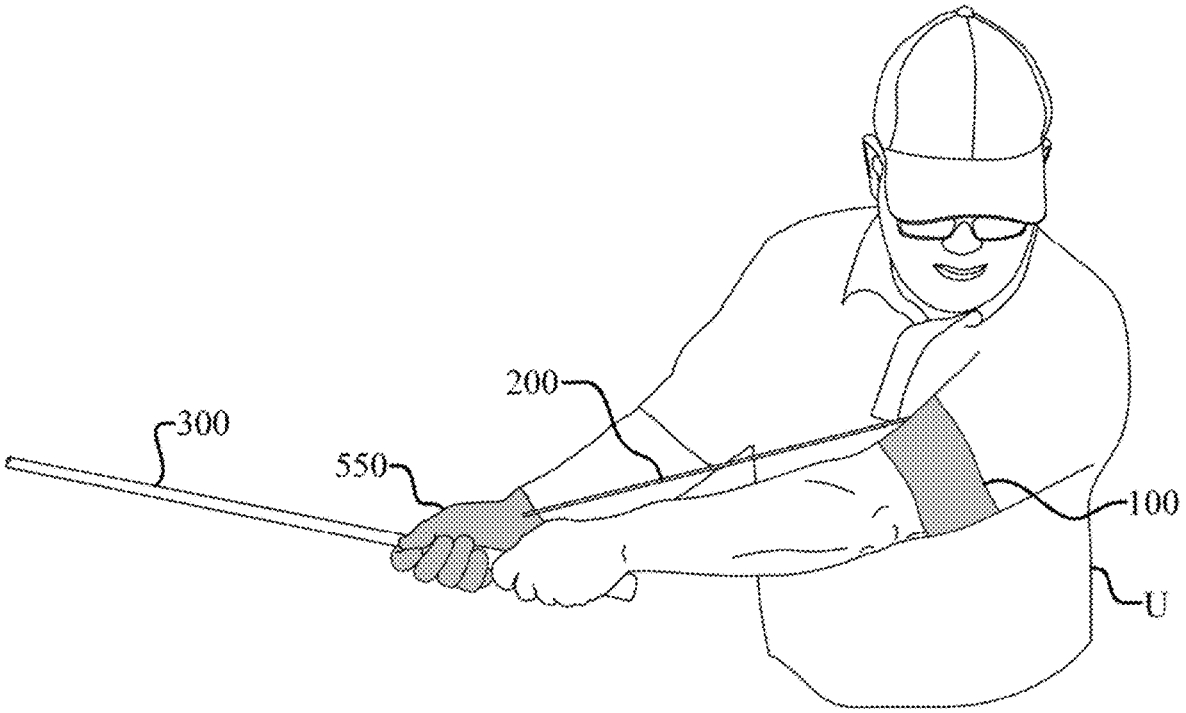
FIG. 7 is a frontal view of a human user employing another embodiment of the shoulder exercise device, with the user and device in a first functional position.

As seen well in FIGS. 5 and 7, the elastic resistance connector (200) has a first functional length, in a first functional position with the human user (U), with the slider (400) positioned at the proximal slider position (360) of the extender slidable portion (340) and the connector (100) secured to the elbow, or the peri-condylar humeral area proximate to the humerus, of a human user (U). The first functional position is that where the retainer (100) is affixed to the elbow, or peri-condylar humeral area of the arm, of a user (U), the grippable slider (400) is slidably engaged with the extender (300) and is at the proximal slider position (360) along the extender slidable portion (300), and the human user (U) is gripping the grippable slider (400) and the extender grip portion (330) and has induced sufficient extension of the elbows so as to begin to stretch the elastic resistance connector (200) beyond the unstretched length.

Figure 6:
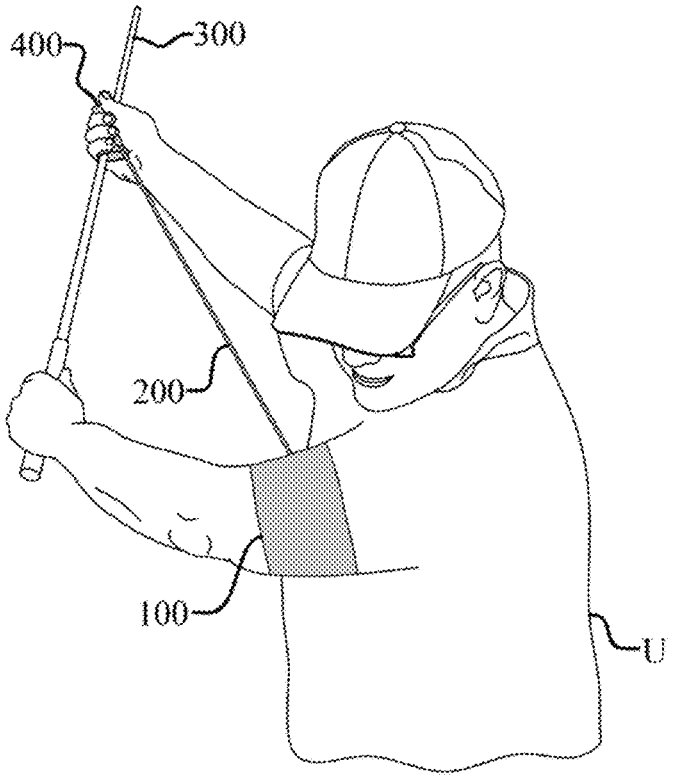
FIG. 6 is a frontal view of a human user employing the embodiment of the shoulder exercise device as seen in FIG. 5, with the user and device in a second functional position.
Figure 8:
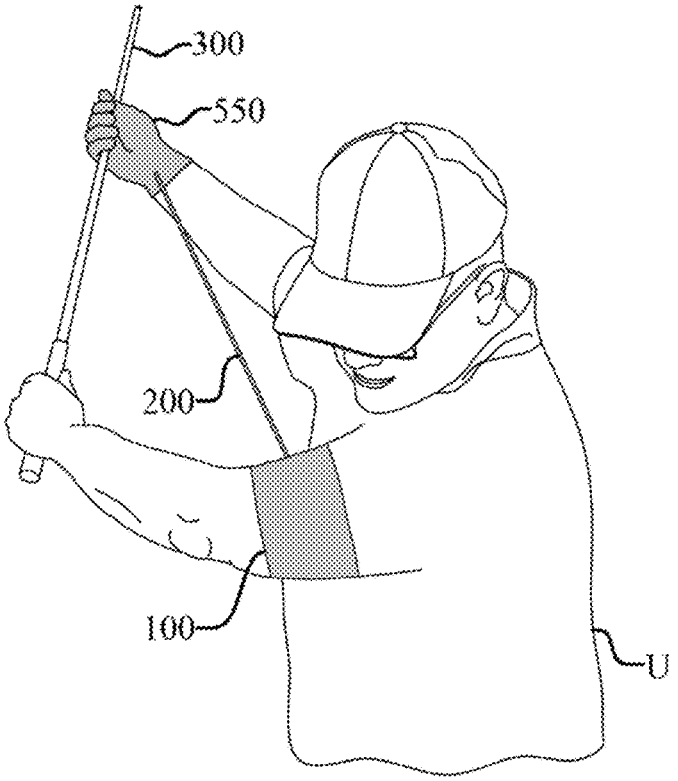
FIG. 8 is a frontal view of a human user employing the embodiment of the shoulder exercise device as seen in FIG. 7, with the user and device in a second functional position.

As seen well in FIGS. 6 and 8, the elastic resistance connector (200) has a second functional length, in a second functional position with the human user (U), greater than the first functional length, with the slider (400) positioned at the distal slider position (370) of the extender slidable portion (340) and the connector (100) is secured to the elbow, or the peri-condylar humeral area proximate to the humerus, of a human user (U). The second functional position is that where the retainer (100) affixed to the elbow, or the peri-condylar humeral area of the arm, of a user (U), the grippable slider (400) is slidably engaged with the extender (300) and is at the distal slider position (370) along the extender slidable portion (300), and the human user (U) is gripping the grippable slider (400) and the extender grip portion (330) and has induced sufficient extension of the elbows and torso rotation so as to stretch the elastic resistance connector (200) to a maximal exercising length.

In one embodiment the extender (300) includes a pair of stops to limit the sliding range of the slider (400), thereby defining the extender proximal slider position (360) as that position wherein the slider (400) rests against a proximal stop, and defining the extender distal slider position wherein the slider rests against a distal stop, and/or such stops may simply retain the slider (400) on the extender (300). In another embodiment the extender (300) includes at least one stop to limit the sliding range of the slider (400), such as a distal stop; whereas in an alternative embodiment the at least one stop includes a proximal stop. The stop, or stops, may be user adjustable for customization to the user's desired range of motion.

As may be inferred between FIGS. 5 and 6, and again between FIGS. 7 and 8, the elastic resistance connector (200) has a plurality of functional lengths with the slider (400) positioned at a plurality of positions between the proximal slider position (360) (FIGS. 5 and 7) and the distal slider position (370) (FIGS. 6 and 8) along the axial length of the extender (300) and the connector (100) secured to the elbow or the peri-condylar humeral area proximate to the humerus of a human user (U), and the arms are extended while the torso is rotated.

In some embodiments, the unstretched connector length is at least 6 inches, while in other embodiments the unstretched connector length is at least 10 inches. Similarly, in at least one embodiment, the unstretched connector length is less than 22 inches. In certain embodiments, the connector length increases by at least 2 inches when subjected to an axial tensile load of 5 lbf, while in yet another embodiment the connector length increases by at least 4 inches when subjected to an axial tensile load of 5 lbf. In a further embodiment the connector length increases by no more than 8 inches when subjected to an axial tensile load of 5 lbf, while in yet another embodiment the connector length increases by no more than 6 inches when subjected to an axial tensile load of 5 lbf. Embodiments having a resistance connector (200) that is elastic provide additional comfort and safety during use, reducing the likelihood of overstretching the shoulder.

In various embodiments, by means of example only and not limitation, the slidable portion length (342) is at least 12 inches, while in other contemplated embodiments, the slidable portion length (342) is at least 24 inches, and in an even further embodiment the slidable portion length (342) is at least 30 inches. Further, in one embodiment the elastic resistance connector (200) has an ultimate tensile strength of at least 50 lbf, whereas in another embodiment it may have an ultimate tensile strength of at least 100 lbf, and in an even further embodiment the ultimate tensile strength may be at least 150 lbf. In an alternative embodiment the connector (200) is not elastic and elongates less than 5% under a tensile load of 150 lbf.

Figure 9:
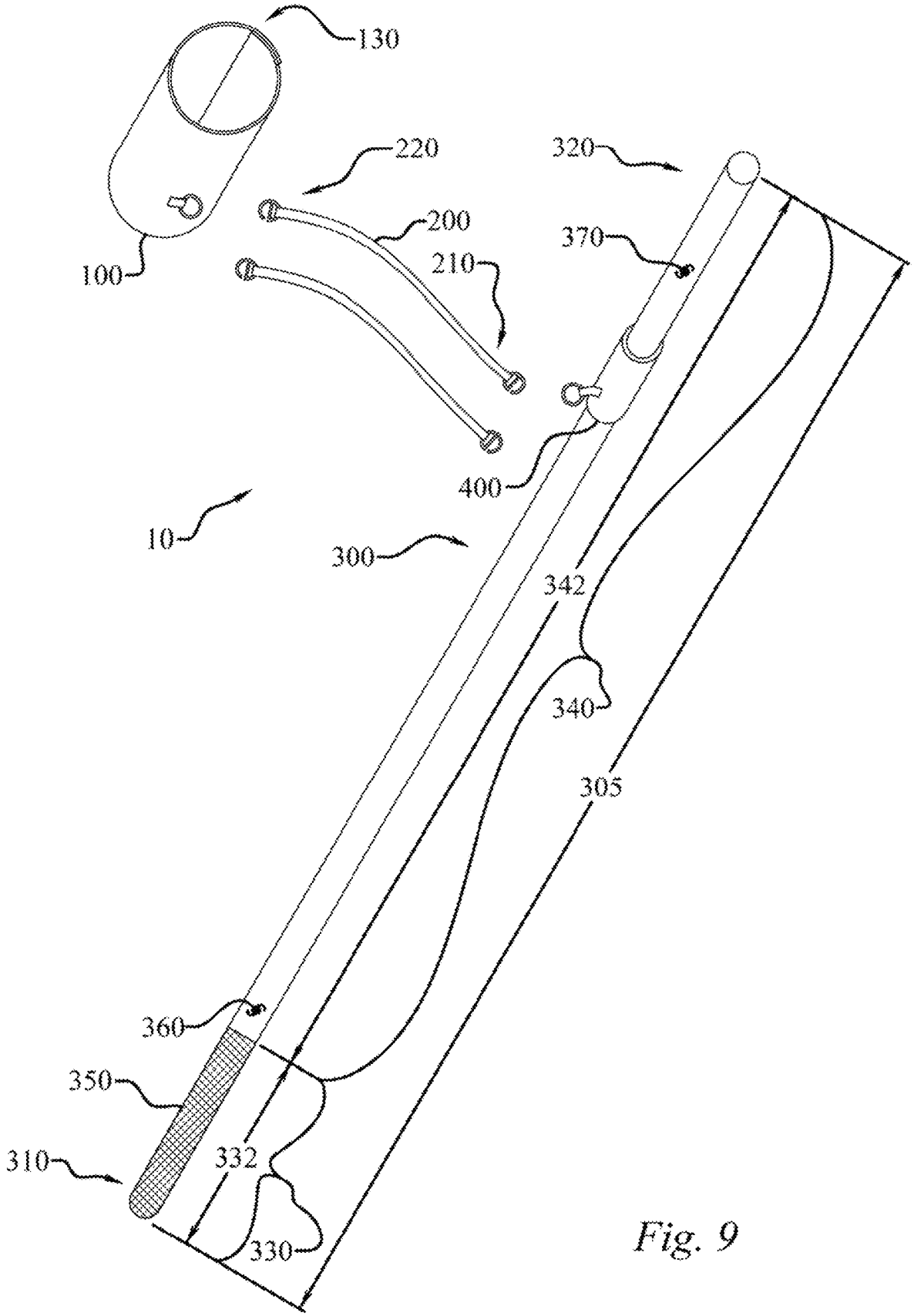
FIG. 9 is a perspective view of an embodiment of a shoulder exercise device.
Figure 10:
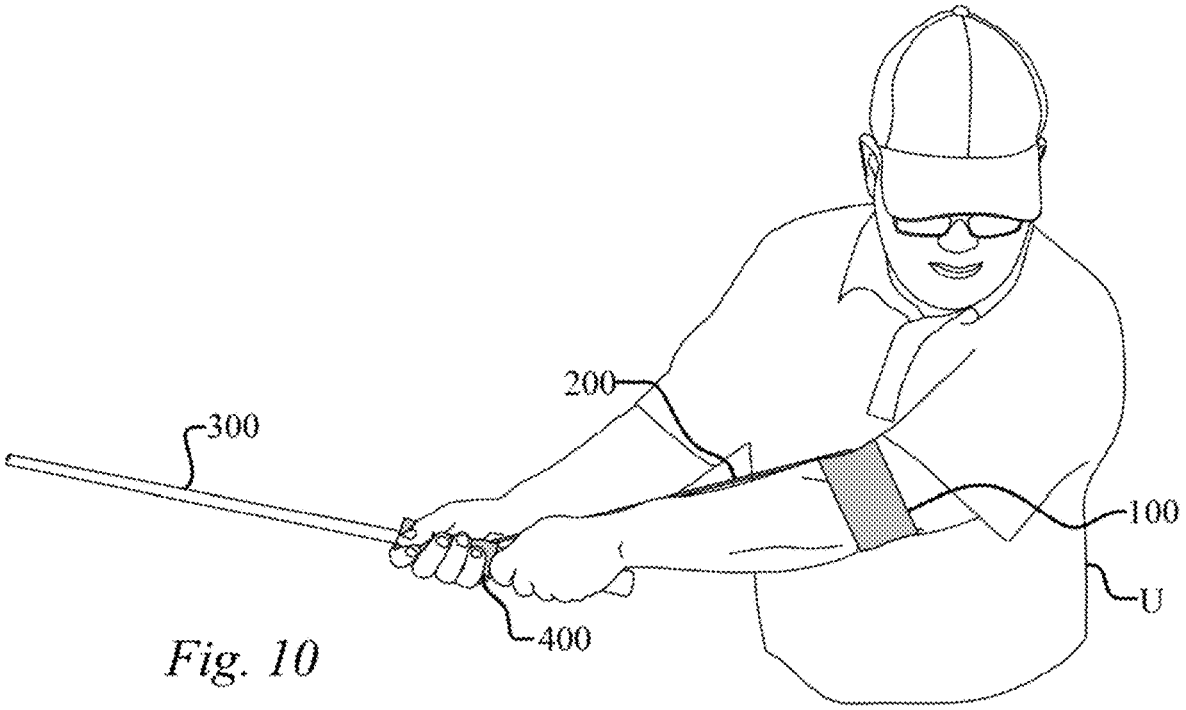
FIG. 10 is a frontal view of a human user employing an embodiment of the shoulder exercise device.
Figure 11:
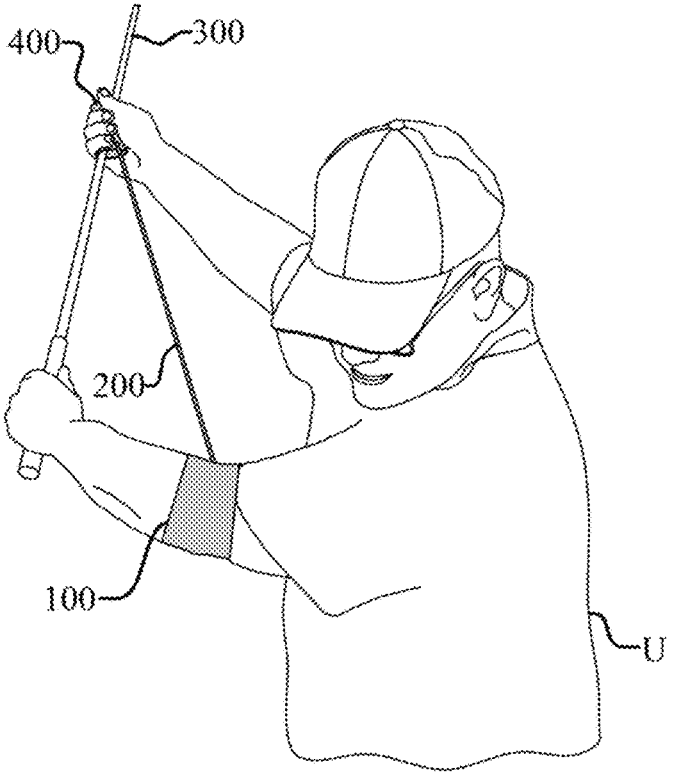
FIG. 11 is a frontal view of a human user employing an embodiment of the shoulder exercise device.

In some embodiments, such as that seen in FIG. 9, the slider (400) and the connector (100) are configured to accommodate releasable attachment of one or more connectors (200). In one such embodiment both the slider (400) and the connector (100) have an attachment ring, which may be rigid, such as plastic or metal, or flexible, such as fabric, nylon, or neoprene, just to name a few, to which one or more connectors (200) may be releasably attached. In such embodiments a kit may include multiple elastic resistance connectors (200) having different elastic properties so the user (U) may select the desired connector (200) and easily change them out depending on their strength and flexibility. In one such embodiment the kit includes at least two elastic resistance connectors (200), with one having at least 50% more stretch than the other when subjected to an axial tensile load of 5 lbf; whereas in a further embodiment the kit includes at least two elastic resistance connectors (200), with one having at least 75% more stretch than the other when subjected to an axial tensile load of 5 lbf; and in yet another embodiment the kit includes at least two elastic resistance connectors (200), with one having at least 100% more stretch than the other when subjected to an axial tensile load of 5 lbf. Alternatively, in another embodiment the kit includes at least two elastic resistance connectors (200) having the same elastic properties so that the use (U) can elect to exercise with a single connector (200), or multiple connectors (200). In one particular embodiment a connector (200) is constructed of surgical latex tubing having an inner diameter of approximately ¼" and an outer diameter of approximately 7/16-9/16".

In some embodiments it is desirable to have the shoulder motion exercise device (10) possess a unique weight and weight distribution that is comfortable and easy to handle. One skilled in the art is familiar with U.S. Pat. No. 1,953,916 titled "Apparatus for Measuring Moments of Golf Clubs and the Like," which discloses an instrument for measuring the amount of torque the weight of an object exerts about a pivoting fulcrum located 14" from the end of the object. This device is particularly well known in the field of golf equipment.

In one embodiment, with the closest portion of the slider (400) positioned 6 inches from the extender proximal end (310), an overall weight distribution of the extender (300) and the slider (400) produce a torque of 3000-10000 gram*inches about a fulcrum located 14" from the extender proximal end (310), which is easily measured using such a swing weight apparatus. In a further embodiment the combined weight of the extender (300) and the slider (400) is 100-800 grams, thereby providing a weight and weight distribution that is comfortable and convenient to handle even for users undergoing shoulder rehabilitation. In an even further embodiment the weight and weight distribution is intended to mimic that of a golf club and the torque is 5000-8000 gram*inches, while in an even further embodiment the torque is 5500-7000 gram*inches, which closely simulates the weight distribution associated with a golf club having a swing weight of C3 through E7 on what is commonly referred to as the "Lorythmic" scale. In still a further embodiment that mimics the weight and weight distribution of a golf club the combined weight of the extender (300) and the slider (400) is 250-500 grams. In one embodiment the extender (300) is solid, in another embodiment the extender (300) is hollow, and in yet a further embodiment the extender (300) is tapered, while in an even further embodiment the extender (300) is hollow having a wall thickness that varies throughout at least a portion of the length. Such embodiments are beneficial in achieving the desired weight and weight distribution. Further, the extender (300) may also include weights placed in the body of the extender (300) to achieve the desired weight and weight distribution. Even further, in another embodiment the extender (300) cooperates with at least one removably attachable weight so that the user may adjust the weight and weight distribution. Such weights may be designed to snap-on the extender (300) and in some embodiments may further act as the disclosed stops. An even further embodiment includes a repositionable sliding weight that may be adjusted along a portion of the extender (300), and in one embodiment the length of the sliding weight adjustability range is at least 12 inches, which in another embodiment is at least 24 inches. The extender (300) may be constructed of metallic or nonmetallic materials such as plastic, fiber reinforced plastic, and prepreg materials.

In another embodiment the extender (300) includes at least one elongated recess, or track, that cooperates with a portion of the slider (400) to eliminate rotation of the slider (400) as it travels along the extender (300). Alternatively, in another embodiment the extender (300) includes at least one elongated projection, or rail, that cooperates with a portion of the slider (400) to eliminate rotation of the slider (400) as it travels along the extender (300). The elongated recess or projection embodiments may further serve to limit the range of motion of the slider (400) along the extender (300).

Figure 12:
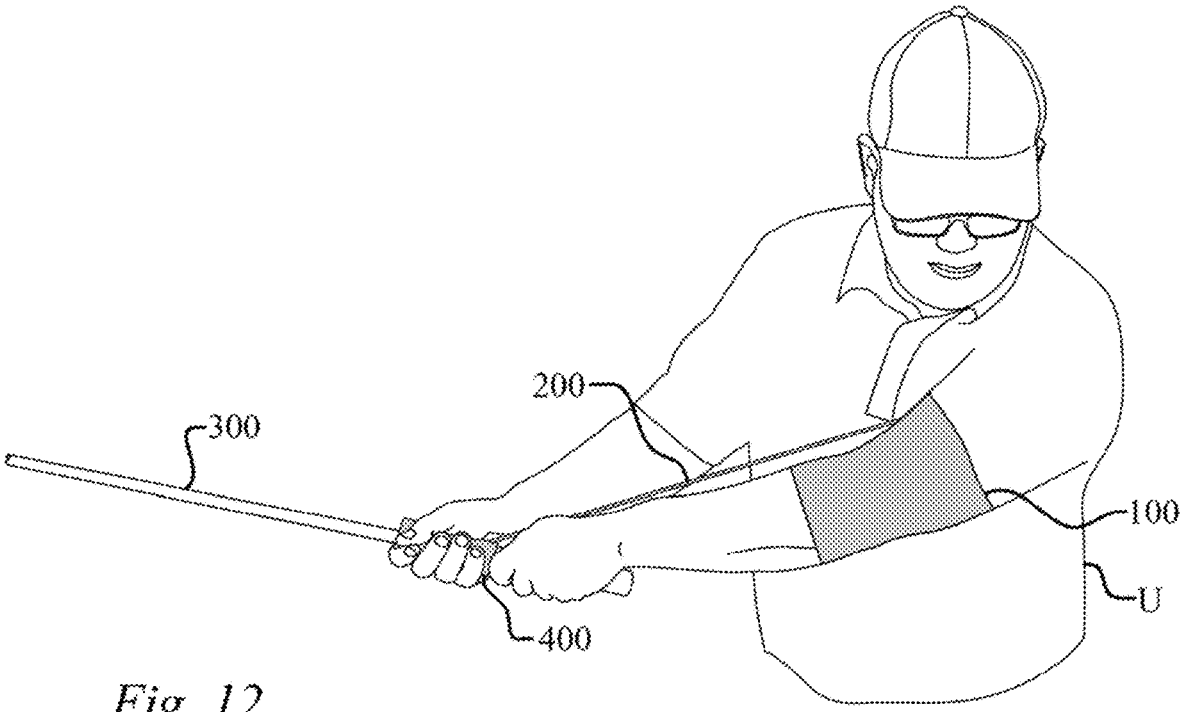
FIG. 12 is a frontal view of a human user employing an embodiment of the shoulder exercise device.
Figure 13:
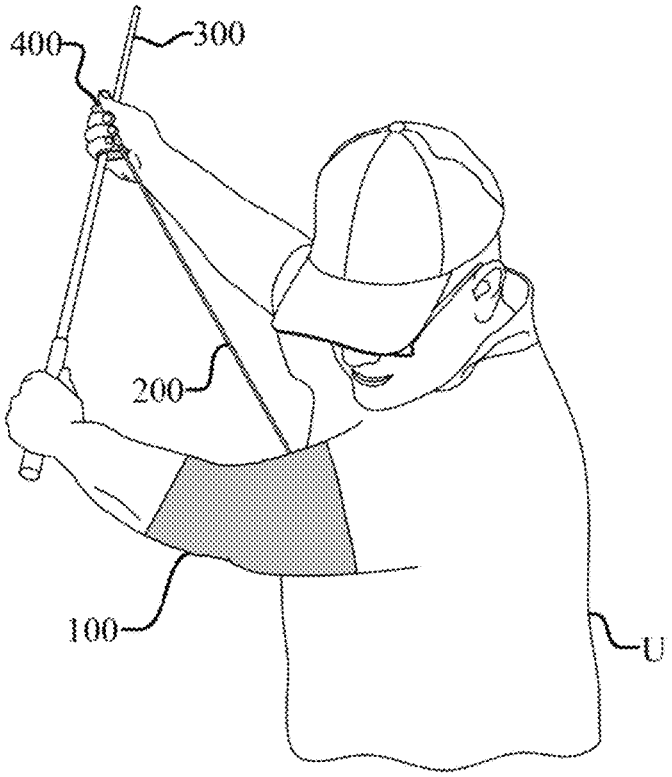
FIG. 13 is a frontal view of a human user employing an embodiment of the shoulder exercise device.

In some embodiments, seen well in FIGS. 3 and 4, the retainer (100) may include a band having a width, a length, a first end (110), and a second end (120), wherein the first end (110) and second end (120) are releasably joinable at a retainer release point (130) to form a continuous band of a given circumference. The retainer (100) may incorporate a hook-and-loop fastening system, snaps, clips, or any easily functioning connection system that may be attached and removed by the user (U) using a single hand, while also affording the strength to carry out the stretches and exercises. One particular embodiment ensures the retainer (100) is secured at, or above, the elbow of the user (U) by incorporating a minimum adjustable size, or circumference, of at least 9" so that it would be loose and nonfunctional around the wrist of the user (U), while in a further embodiment the minimum adjustable size of at least 11", while in an even further embodiment the body of the retainer (100) is constructed of elastic material such that in an unstretched state the minimum adjustable size of at least 9". In yet another embodiment the retainer (100) is configured as an elbow brace, as seen in FIGS. 12 and 13, having discreet portions for above-the-elbow and below-the-elbow, with the connector (200) joined to the above-the-elbow portion to further promote proper installation of the retainer (100) and stretching of the shoulder without bending of the elbow.

The grippable slider (400) is subject to a wide range of constructions, as one skilled in the art would immediately realize. For example, in one embodiment, seen well in FIGS. 7 and 8, the grippable slider (400) is a glove (550), having a sufficiently low coefficient of friction across the palm such that it might slide along a loosely held extender (300). In this embodiment the glove (550) is configured for attachment to the connector (200), which in a further embodiment is releasably attached to the connector (200). The extender gripping means (350) and/or the slider gripping means (450) may be any structure or textured surface meant to enhance the ability of the user (U) to grip the slider (400); in further embodiments, the extender gripping means (350) and/or the slider gripping means (450) may include a loop or other device for releasable fixation to the hand of the user (U), particularly for those with low grip strength. In another embodiment, the extender (300) may be the shaft of a golf club and the slider (400) may be any sort of hollow structure that might fit over and be releasably slidably engaged to the shaft.

In one embodiment the shoulder motion exercise device (10) simply includes the retainer (100), connector (200), and slider (400), wherein the grippable slider (400) is sized and configured to slide over the butt-end of an existing golf club, allowing the user (U) to substitute their existing golf club for the extender (300). In this embodiment the slider (400) is configured with an interior opening that can pass a 1.25" diameter object. In yet another embodiment the slider (400) may be composed of multiple pieces that may be joined together once placed around an extender substitute, such as the golf club of the prior example. An even further embodiment incorporates a deformable slider (400) that does not totally encircle the extender (300), or extender substitute, and deforms to facilitate placement on the extender (300), or extender substitute. Other extender substitutes may include a broom, or mop, handle, a dowel rod, a section of pipe, or any object having an axial length sufficient to form an extender slidable portion (340) of sufficient length.

In another series of embodiments, the shoulder motion training device (10) may include a hand-grippable slider (400), slidably engaged to an extender (300), having an axial length, a proximal end (310), an extender gripping portion (330), a distal end (320). The extender (300) may have an extender slidable portion (340) having a proximal slider position (360) and a distal slider position (370) along the axial length. The hand-grippable slider (400) may be coupled to a proximal end (210) of an elastic resistance connector (200) coupled at a distal end (220) of the elastic resistance connector (200) to a retainer (100) which is, in turn, releasably securable to an arm of a human user (U). In one embodiment the extender gripping portion (330) is simply a textured friction-promoting surface to provide an adequate gripping surface during use, however in a further embodiment the extender gripping portion (330) is a separate grip structure applied to the extender (300), and in an even further embodiment the extender gripping portion (330) and slider (400) are sized and configured to simulate a conventional golf grip, however the extender gripping portion (330) remains fixed on the extender (300) while the slider (400) portion may separate from the extender gripping portion (330) and move along the extender (300). In a further embodiment the grip portion length (332) is 3.5"-8" and the length of the slider (400) is 3.5"-8", while in an even further embodiment the grip portion length (332) is 4"-7" and the length of the slider (400) is 4"-7". In yet another embodiment further promoting the feel and balance of a golf club the combined mass of the extender gripping portion (330) and slider (400) is 25-100 grams, while in a further embodiment the combined mass of the extender gripping portion (330) and slider (400) is 50-85 grams.

In such a series of embodiments, the device (10) may have a first operating position with the retainer (100) releasably secured at or above the elbow, in which the slider (400) is positioned at the extender proximal slider position (360), creating a first elastic resistance connector (200) functional length between the slider (400) and the retainer (100). Such a first operating position may be seen well in FIGS. 5 and 7. Similarly, a second operating position may be created with the retainer (200) releasably secured at or above the elbow, in which the slider (400) is positioned at the extender distal slider position (370), creating a second elastic resistance connector (200) functional length between the slider (400) and the retainer (100). Such a first operating position may be seen well in FIGS. 6 and 8. Between the first and second operating positions, there may then be a plurality of intermediate operating positions with the retainer (200) releasably secured at, or above, the elbow, in which the slider may be positioned at any point along the axial length of the extender (300) between the extender proximal slider position (360) and the extender distal slider position (370), creating a plurality of intermediate functional elastic resistance connector (200) lengths between the slider (400) and the retainer (100). These intermediate positions may be envisioned as the intermediate positions between that seen in FIG. 5 and FIG. 6, as well as those positions between that seen in FIG. 7 and FIG. 8.

One skilled in the art will easily recognize at least one method of using the device as taught herein in as a general stretching and exercise program, as may be prescribed for post-surgery rehabilitation, or to improve flexibility of the shoulders and strengthen the core and arms of an athlete for such sports as golf, tennis, racketball, baseball, football, cricket, softball, squash, handball, and any number of track and field events. A method for shoulder motion exercise may include, as a first step, releasably attaching a retainer (100)

at, or above, the elbow of a human user (U). Next, the user (U) might grip an extender (300) having an axial length, a proximal end (310), an extender gripping portion (330) and a distal end (320). Such an extender (300) may have an extender slidable portion (340) having a proximal slider position (360) and a distal slider position (370) along the axial length, and be gripped across the palm in a first-side hand of the human user (U), on the same anatomical side as the first-side humerus, the first-side hand being on the same anatomical side as a first-side shoulder of the human user (U).

One may then place a hand-grippable slider (400), slidably engaged to the extender (300) at the proximal slider position (360) on the axial length of the extender (300). The hand-grippable slider (400) may coupled to a proximal end (210) of a connector (200) coupled at a distal end (220) of the connector (200) to the retainer (100). The user (U) may then grip the hand-grippable slider (400) across the palm in a second-side hand of the human user (U), the second-side hand being on the same anatomical side as a second-side shoulder of the human user (U) and opposite the anatomical side of the first-side hand and the first-side shoulder. Next, the user (U) may vertically elevate the first-side hand and second-side hand away from the torso, placing the second-side shoulder in a position of anterior adduction away from the torso of the human user (U). The first-side shoulder would then be in a position of anterior abduction across the torso, with the torso in a rotationally neutral position and both elbows in a position of extension, allowing the user (U) to angulate the distal end (320) of the extender (300) towards a position lateral to the second-side shoulder.

The user (U) would then simultaneously rotate the torso toward the second-side shoulder, horizontally abducting the first-side shoulder of the user and horizontally adducting the second-side shoulder while maintaining both elbows in extension, while at the same time moving the slider (400) from the proximal slider position (360) toward the distal slider position (370) along the axial length of the extender (300). One skilled in the art, in contemplation of FIGS. 5-8, will realize that in one embodiment the elastic component of the elastic resistance connector (200), being fastened at, or just above, the elbow of the user (U), will exert a force tending to help keep the elbow of the arm gripping the extender (300) from bending or flexing; thereby helping to mimic and encouraging the maintenance of good golf swing dynamics. Thus, in FIG. 6, the user's (U) movement of the slider (400) up the extender (300), while rotating the torso, results in the connector (200) pulling the left arm into a position that is most likely not ordinarily achievable during an ordinary practice swing, and stretches the muscles of the left shoulder and torso.

The exercise would then return to a starting functional position by simultaneously rotating the torso toward the first-side shoulder, horizontally adducting the first-side shoulder of the user and horizontally abducting the second-side shoulder while maintaining both elbows in extension, while at the same time moving the slider (400) from the distal slider position (370) to the proximal slider position (360) along the axial length of the extender (300). In certain embodiments, the first-side hand may be a functionally nondominant-side hand of the human user (U), while in others; the first-side hand is a functionally dominant-side hand of the human user (U). By alternating the side of the first-side hand, the user (U) may work towards stretching and strengthening both shoulders equally, as well as exercising the torso in rotation to both sides. One skilled in the art will appreciate how this same method and procedure may be likewise carried out using the glove embodiment of FIGS. 7 and 8. Further, the shoulder motion exercise device (10) may be a kit including the retainer (100), connector (200), and slider (400), in any of the disclosed embodiments; a kit including the retainer (100), connector (200), and glove (550), in any of the disclosed embodiments; and/or either of these kits further including an extender (300), in any of the disclosed embodiments.

Numerous alterations, modifications, and variations of the preferred embodiments disclosed herein will be apparent to those skilled in the art and they are all anticipated and contemplated to be within the spirit and scope of the disclosed specification. For example, although specific embodiments have been described in detail, those with skill in the art will understand that the preceding embodiments and variations can be modified to incorporate various types of substitute and or additional or alternative materials, relative arrangement of elements, order of steps and additional steps, and dimensional configurations. Accordingly, even though only few variations of the method and products are described herein, it is to be understood that the practice of such additional modifications and variations and the equivalents thereof, are within the spirit and scope of the method and products as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A shoulder motion exercise kit, comprising:

a hand-grippable slider (400), slidably engaged to an extender (300) having an extender axial length (305), a proximal end (310), an extender gripping portion (330) applied to the extender (300) for grasping by a non-dominant hand of a user (U) and having a grip portion length (332) of 3.5"-8" and sized and configured with the slider (400) to simulate a conventional golf grip, a distal end (320), and an extender slidable portion (340) having a slidable portion length (342), a proximal slider position (360), wherein a portion of the slider (400) is within 8 inches of the proximal end (310), and a distal slider position (370) along the slidable portion length (342), wherein the hand-grippable slider (400) is releasably coupled to a proximal end (210) of an elastic resistance connector (200) and releasably coupled at a distal end (220) of the elastic resistance connector (200) to a retainer (100) configured to be releasably securable to a non-dominant arm of the user (U), wherein the elastic resistance connector (200) has an unstretched connector length, wherein the slider (400) is a hollow structure with a slider length of 3.5"-8", an exterior surface, and an interior surface, and wherein the interior surface of the slider (400) encircles a portion of the extender (300) and is only removable from the extender (300) at the proximal end (310) or the distal end (320), the exterior surface of the slider (400) is configured to be held by at least three fingers and gripped across a portion of a palm of a dominant hand of the user (U), and the combined mass of the extender gripping portion (330) and the slider (400) is 25-100 grams;

the elastic resistance connector (200) has a first functional length, in a first functional position with the user (U), with the slider (400) positioned at the proximal slider position (360) of the extender slidable portion (340) and the retainer (100) secured to the non-dominant arm of the user (U);

the elastic resistance connector (200) has a second functional length, in a second functional position with the user (U), greater than the first functional length, with the slider (400) positioned at the distal slider position (370) of the extender slidable portion (340) with the dominant hand spaced apart from the non-dominant hand after the slider (400) has moved throughout at least 12 inches of the slidable portion length (342), and the retainer (100) secured to the non-dominant arm of the user (U);

the elastic resistance connector (200) has a plurality of functional lengths with the slider (400) positioned at a plurality of positions between the proximal slider position (360) and the distal slider position (370) along the axial length of the extender (300) and the retainer (100) secured to the non-dominant arm of the user (U);

the unstretched connector length is at least 6 inches; and the elastic resistance connector (200) comprising at least two user interchangeable connectors including at least a first elastic resistance connector and a second elastic resistance connector.

2. The kit according to claim 1, wherein the first elastic resistance connector and the second elastic resistance connector have different elastic properties.

3. The kit according to claim 2, wherein when subjected to the same tensile load, at least one of the first elastic resistance connector and the second elastic resistance connector stretches at least 50% more than the other connector.

4. The kit according to claim 3, wherein when subjected to the same tensile load, at least one of the first elastic resistance connector and the second elastic resistance connector stretches at least 100% more than the other connector.

5. The kit according to claim 2, wherein the connector length of at least one of the first elastic resistance connector and the second elastic resistance connector increases by at least 2 inches when subjected to an axial tensile load of 5 lbf.

6. The kit according to claim 5, wherein with a closest portion of the slider (400) positioned 6 inches from the extender proximal end (310), an overall weight distribution of the extender (300) and the slider (400) produce a torque of 3000-10000 gram*inches about a fulcrum located 14" from the extender proximal end (310), and a combined weight of the extender (300) and the slider (400) is 100-800 grams.

7. The kit according to claim 6, wherein the torque is 5000-8000 gram*inches.

8. The kit according to claim 1, wherein the first elastic resistance connector and the second elastic resistance connector are both connected to the slider (400) and the retainer (100) at the same time.

9. The kit according to claim 1, wherein the unstretched connector length is less than 22 inches.

10. The kit according to claim 9, wherein the slidable portion length (342) is at least 24 inches.

11. The kit according to claim 10, wherein the torque is 5500-7000 gram*inches.

12. The kit according to claim 9, wherein the retainer (100) comprises a band having a width, a length, a first end (110), and a second end (120), wherein the first end (110) and second end (120) are releasably joinable at a retainer release point (130) to form a continuous band.

13. The kit according to claim 9, wherein the elastic resistance connector (200) is formed of hollow elastic tubing.

14. The kit according to claim 13, wherein the hollow elastic tubing has an outer diameter of 7/16"-9/16".

15. The kit according to claim 9, wherein the elastic resistance connector (200) has an ultimate tensile strength of at least 50 lbf.

16. The kit according to claim 9, wherein the extender (300) is formed of nonmetallic material.

17. The kit according to claim 1, wherein a weight is attached to the extender (300).

18. The kit according to claim 17, wherein the weight limits the range of movement of the slider (400).

19. The kit according to claim 18, wherein the weight retains the slider (400) on the extender (300).

20. A shoulder motion exercise kit, comprising:

a hand-grippable slider (400), slidably engaged to an extender (300) having an extender axial length (305), a proximal end (310), an extender gripping portion (330) applied to the extender (300) for grasping by a non-dominant hand of a user (U) and having a grip portion length (332) of 3.5"-8" and sized and configured with the slider (400) to simulate a conventional golf grip, a distal end (320), and an extender slidable portion (340) having a slidable portion length (342), a proximal slider position (360), wherein a portion of the slider (400) is within 8 inches of the proximal end (310), and a distal slider position (370) along the slidable portion length (342), wherein the hand-grippable slider (400) is releasably coupled to a proximal end (210) of an elastic resistance connector (200) and releasably coupled at a distal end (220) of the elastic resistance connector (200) to a retainer (100) configured to be releasably securable to a non-dominant arm of the user (U), wherein the elastic resistance connector (200) has an unstretched connector length and an ultimate tensile strength of at least 50 lbf, wherein the slider (400) is a hollow structure with a slider length of 3.5"-8", an exterior surface, and an interior surface, and wherein the interior surface of the slider (400) encircles a portion of the extender (300) and is only removable from the extender (300) at the proximal end (310) or the distal end (320), the exterior surface of the slider (400) is configured to be held by at least three fingers and gripped across a portion of a palm of a dominant hand of the user (U), and the combined mass of the extender gripping portion (330) and the slider (400) is 25-100 grams;

the elastic resistance connector (200) has a first functional length, in a first functional position with the user (U), with the slider (400) positioned at the proximal slider position (360) of the extender slidable portion (340) and the retainer (100) secured to the non-dominant arm of the user (U);

the elastic resistance connector (200) has a second functional length, in a second functional position with the user (U), greater than the first functional length, with the slider (400) positioned at the distal slider position (370) of the extender slidable portion (340) with the dominant hand spaced apart from the non-dominant hand after the slider (400) has moved throughout at least 12 inches of the slidable portion length (342), and the retainer (100) secured to the non-dominant arm of the user (U);

the elastic resistance connector (200) has a plurality of functional lengths with the slider (400) positioned at a plurality of positions between the proximal slider position (360) and the distal slider position (370) along the axial length of the extender (300) and the retainer (100) secured to the non-dominant arm of the user (U);

the unstretched connector length is 6-22 inches;

the elastic resistance connector (200) comprising at least two user interchangeable connectors including at least a first elastic resistance connector and a second elastic resistance connector, wherein the first elastic resistance connector and the second elastic resistance connector have different elastic properties; and a weight is attached to the extender (300) and retains the slider (400) on the extender (300).

* * * * *